US006194077B1

(12) United States Patent
Yuan et al.

(10) Patent No.: US 6,194,077 B1
(45) Date of Patent: Feb. 27, 2001

(54) WATERFAST INK RECEPTIVE MATERIAL

(75) Inventors: Shengmei Yuan, Coventry; Khanh Nguyen; Steven J. Sargeant, both of West Warwick, all of RI (US)

(73) Assignee: Arkwright Incorporated, Fiskeville, RI (US)

( * ) Notice: Subject to any disclaimer, the term of this patent is extended or adjusted under 35 U.S.C. 154(b) by 0 days.

(21) Appl. No.: 09/186,641

(22) Filed: Nov. 6, 1998

Related U.S. Application Data

(60) Provisional application No. 60/064,473, filed on Nov. 6, 1997, now abandoned.

(51) Int. Cl.[7] ..... B41M 5/00
(52) U.S. Cl. ..... 428/478.2; 428/195; 428/500
(58) Field of Search ..... 428/195, 478.2, 428/500

(56) References Cited

U.S. PATENT DOCUMENTS

| | | | |
|---|---|---|---|
| 5,118,570 | 6/1992 | Malhotra | 428/474.4 |
| 5,141,599 | 8/1992 | Jahn et al. | 162/137 |
| 5,180,624 | 1/1993 | Kojima et al. | 428/211 |
| 5,206,071 | 4/1993 | Atherton et al. | 428/195 |
| 5,364,702 | 11/1994 | Idei et al. | 428/423.1 |
| 5,474,843 | 12/1995 | Lambert et al. | 428/327 |
| 5,532,064 | 7/1996 | Lubar | 428/478.2 |

FOREIGN PATENT DOCUMENTS

| | | |
|---|---|---|
| 0484016A1 | 10/1991 | (EP) . |
| 0709438A1 | 10/1995 | (EP) . |
| 0767071A1 | 10/1996 | (EP) . |
| WO 9516561 | 6/1995 | (WO) . |
| WO 96/18496 | 6/1996 | (WO) . |

*Primary Examiner*—Bruce H. Hess
(74) *Attorney, Agent, or Firm*—Birch, Stewart, Kolasch & Birch, LLP

(57) ABSTRACT

The present invention provides a water-insoluble ink receptive coating comprising a gelatin, a water-insoluble quaternary cationic polymer, which are crosslinked together by a multifunctional cross-linking agent to form a water-insoluble ink receptive coating layer for ink jet recording. The ink receptive coatings can additionally contain a pigment to make a matte or glossy medium with no tacky feel.

19 Claims, No Drawings

WATERFAST INK RECEPTIVE MATERIAL

This application claims priority on provisional application Ser. No. 60/064,473 filed on Nov. 6, 1997, the entire contents of which are hereby incorporated by reference, now abandoned.

FIELD OF THE INVENTION

The present invention relates to an ink receptive material, and more particularly, to waterfast ink receptive coating layer for ink jet recording.

BACKGROUND OF THE INVENTION

The quality of waterfastness is of primary importance for today's ink jet media products. The term "waterfast" may be defined as the quality of being impervious to the effects of water. Products normally used out of doors, such as billboards, signs, etc., require protection from typical outdoor moisture sources such as rain, humidity, etc. Traditionally, non-waterfast ink jet film products have been laminated at high cost in order to enable outdoor usage. Ink jet office products also require waterfast properties to protect the printed image from typical indoor moisture sources such as humidity or the occasional spilled cup of coffee, etc.

Previous efforts to prepare waterfast ink jet film media involved mixing water-soluble polymer binders with water-soluble dye-fixing agents in an ink-receptive coating layer for an ink jet medium. While this approach can impart a certain amount of dye-fixing capability to the media, it does not give a substantially waterfast media. This is because most of the polymer binders and dye-fixing agents are water-soluble and do not give good wet adhesion to the base substrate. As a result, when contacted with water, these coatings swell and come off the substrates.

U.S. Pat. No. 5,439,739 discloses an ink jet recording medium comprising a support and at least one ink jet receiving layer, said ink receiving layer comprising a water-soluble polymer obtained by co-polymerizing 10–50 parts by weight of a quaternary salt monomer, 1–30 parts by weight of an amino group containing monomer or a carboxyl group containing monomer and 20–80 parts by weight of a monomer selected from acrylamide, methacrylamide, N,N-dimethacrylamide, N-isopropylacrylamide, diacetone acrylamide, N-methylolacrylamide, 2-hydroxyethyl-(meth) acrylate, and N-vinylpyrrolidone, and 0.1–30 parts by weight of a cross-linking agent.

U.S. Pat. Nos. 5,472,789 and 5,389,723 disclose a liquid-absorbent composition comprising a blend of (a) at least one polymeric matrix component comprising a cross-linkable polymer derived from α, β-ethylenically unsaturated monomers, (b) at least one polymeric liquid-absorbent component, (c) polyfunctional aziridine as a crosslinking agent, said composition capable of forming semi-interpenetrating networks wherein said at least one polymeric matrix component is crosslinked and said at least one liquid-absorbent component is uncrosslinked, said uncrosslinked liquid-absorbent component being able of being dissolved in the liquid that it is capable of absorbing.

U.S. Pat. No. 4,649,064 claims an ink-receiving layer containing (a) a hydrophilic cross-linkable film-forming material which is crosslinked to a degree sufficient to render it waterfast, while permitting it to rapidly absorb a water-based ink, (b) a crosslinking agent that is capable of crosslinking a cross-linkable colorant/resin composition in a water-based liquid ink.

WO 96/18496 discloses a water resistant ink jet receiving medium comprising an ink receptive layer of a crosslinked vinyl amide acrylic acid or methacrylic acid or ester thereof random copolymer and a cationic resin.

U.S. Pat. No. 5,532,064 discloses an ink-absorption layer having crosslinked gelatin in admixture with an amide in low concentration, generally less than approximately 1% or 2% by weight.

U.S. Pat. No. 4,701,837 discloses an ink-receiving layer mainly containing a water-soluble polymer and a crosslinking agent.

U.S. Pat. No. 5,206,071, entitled "Archivable Ink Jet Recording Media," discloses film media that are useful in ink jet printing, and which comprise a transparent, translucent or opaque substrate, having on at least one side thereof a water-insoluble, water-absorptive and ink-receptive matrix, said matrix comprised of a hydrogel complex and a polymeric high molecular weight quaternary ammonium salt.

U.S. Pat. No. 5,474,843 and WO 95/16561 disclose an ink-accepting coating layer containing (a) a water-soluble mordant that forms an insoluble compound with, and immobilizes the dyestuffs of, the ink jet inks, (b) a water-absorbing solid polymer, wherein said polymer has been rendered insoluble in water at room temperature by chemical hardening of said polymer at elevated temperature in an aqueous coating solution prior to coating of said coating solution, and (c) non-porous polymer beads dispersed in said water-absorbing polymer in an uppermost layer of said ink-accepting composition.

SUMMARY OF THE INVENTION

It is an object of the present invention to provide an ink receptive coating layer for ink jet recording that is waterfast while also having good water absorptivity, good dye-fixing capability and good adhesion to the base substrate. It is a further object of the present invention to provide a water-insoluble ink receptive material that is comprised of the coating layer applied to a substrate.

The present invention provides a water-insoluble ink receptive coating comprising a gelatin and a water-insoluble quaternary cationic polymer which are cross-linked together with a multifunctional cross-linking agent. Furthermore, a pigment is contained in the ink receptive coating to make a matted or non-tacky ink jet recording medium.

DETAILED DESCRIPTION

In the present invention, a gelatin binder, and a water-insoluble quaternary cationic polymer are cross-linked together with a multifunctional cross-linking agent to form a water-insoluble ink receptive coating for ink jet recording. The ink receptive coating may also contain a pigment to make a matted or non-tacky ink jet recording media. The ink jet coating thus formed may be characterized as having an interpenetrating polymer network (IPN) which imparts to the layer the properties of waterfastness, water absorptivity, and an ability to adhere well to the base substrate.

In order to achieve an IPN with the balanced properties of good wet adhesion, water absorptivity and waterfastness, and balanced cross-linking density, the gelatin, the water-insoluble quaternary cationic polymer, and the multifunctional cross-linking agent of the ink receptive coating layer of the present invention are selected as set forth in the following detailed description.

The gelatin binder that is selected should possess reactive functional groups that can react with the multifunctional cross-linking agent to form the IPN with the water-insoluble quaternary polymer. The gelatin binder imparts good water absorptivity to the ink-receptive coating. The nature of gelling at room temperature makes it a good candidate for making water-insoluble coating.

The gelatin may be a gelatin having a Bloom number from about 100 to about 300 with viscosity from 3.0 to 55 mPa.s. Further, the gelatin may be derived from an acid treated precursor or an alkali treated precursor.

In the inventive water-insoluble ink receptive materials, the content of gelatin in the ink receptive coating layer is from about 30% to about 90%, by weight based on the total weight of the coating layer. Preferably, the content of gelatin in the dried coating is from about 50% to about 70%, by weight based on the total weight of the coating layer.

In the present invention, the water-insoluble quaternary cationic polymer is defined as a quaternary cationic polymer that remain undissolved after immersion in water for 24 hours. This is the key difference from U.S. Pat. No. 5,474,843 and all other patents in which water soluble quaternary cationic polymers or mordants were used. It is the gelling property of gelatin, water insolubility of the quaternary cationic polymer, and the IPN structure due to the crosslinking that gives the materials of the instant invention a balanced image quality and waterfastness. Table I lists the solubility of the most widely used quaternary cationic polymers.

TABLE I

Solubility of Various Quaternary Cationic Polymer Mordants

| Cationic Mordant | Solubility in water* | Notes |
|---|---|---|
| Syntran Hx31–44 & 31–65 (Interpolymer Corp.) | Insoluble | Present invention |
| Celquat H100 (National Starch & Chemicals) | Soluble | Mordant in USP 5,747,843 |
| FlocAid 19 (National Starch & Chemicals) | Soluble | Mordant in USP 5,747,843 |
| Gafquat 755N (International Specialty Polymers) | Soluble | Mordant in WO 96/18496 |
| Agefloc A-50HV (Ciba Specialty Chemicals) | Soluble | Mordant in WO 96/18496 |

*Water solubility was tested by adding 2 grams of the dry chemicals into 98 gram of water, and stirring for 24 hr in ambient conditions. Syntran 31–44 and Syntran HX31–65 come as 35% solids in water and organic co-solvent. Gafquat comes as 20% solids in water. Agefloc A-50HV comes as 5% solids in water. FlocAid 19 comes as 28% solids in water. These solutions were cast into thick film, dried, and crushed/cut into granule before testing.

The water-insoluble quaternary cationic polymer in this invention should possess an average molecular weight of about 1,000–10,000 grams per mole, preferably 3,000 to 6,000 grams per mole. The water-insoluble quaternary cationic polymer should also preferably possess at least one hydrophobic molecular component. The hydrophobic component serves to make the polymer water-insoluble and helps to thereby give the coating water resistance.

The water-insoluble quaternary polymer is preferably a co-polymer derived from at least one water-insoluble monomer and at least one water-soluble monomer. When the water-insoluble quaternary polymer is derived from at least one water-insoluble monomer and at least one water-soluble monomer, the water-insoluble monomer used to prepare the water-insoluble quaternary cationic polymer is preferably selected from the group consisting of alkyl methacrylate and alkyl acrylate. Likewise, in such instances where the water-insoluble quaternary polymer is derived from at least one water-insoluble monomer and at least one water-soluble monomer, the water-soluble monomer used to prepare the water-insoluble quaternary polymer should have at least one reactive functional substituent group, with the reactive substituent group of the water-soluble monomer preferably being selected from the group consisting of hydroxyl-, carboxylic-, and amine-containing substituent groups. Preferably, the water-insoluble quaternary cationic polymer has an acid number of 25 and hydroxyl number of 8, respectively, per mole of the polymer. These reactive functional groups provide the cationic polymer the opportunity to participate in IPN formation. The water-soluble monomer used in preparing the water-insoluble quaternary cationic polymer is preferably selected from the group consisting of quaternized dialkylaminoalkyl methacrylate and methyl quaternized dialkylaminoalkyl acrylate. In the present invention it is also preferable that the cationic polymer has trimethylammonium halogen functional groups.

The content of the water-insoluble quaternary cationic polymer in the dried coating is from about 0% to about 40%. Preferably, the content of water-insoluble quaternary cationic polymer in the dried coating is from about 20% to about 30%, by weight based on the total weight of the coating.

The water-insoluble quaternary cationic polymer may participate in the formation of an IPN in several ways: (1) through a reaction between the functional groups of the water-insoluble quaternary polymer and the cross-linking agent, and a possible reaction between gelatin, either during or after its gelation, and the quaternary cationic polymer; (2) through molecular entanglement with the gelatin; (3) the water-insoluble quaternary cationic polymer can contain a hydrophobic moiety or moieties that become entrapped in the polymer binder and thereby provide the coating with water resistance.

Most conventional media described in the art do not have substantial waterfastness due to following reasons: (1) their polymer binders lack sufficient cross-linking density; (2) their cationic mordants lack functional groups that can react with cross-linking agents and/or participate in the formation of an IPN, (3) their cationic mordants do not have sufficient molecular weight to become entangled in the polymer binder network; (4) their cationic mordants are water soluble and do not give their coatings water resistance.

Cationic polymer mordant only gives the coating dye-fixing capability while the crosslinked network and the hydrophobic property of the binder and the cationic mordant give the coating water resistance. The combination of dye-fixing capability and water resistance is essential for producing a waterfast ink jet recording media. Most commercial quaternary cationic polymer mordant are water-soluble and have no hydrophobic property or reactive functional group. They can not participate in the crosslinked network and gives no water resistance to the coating. In contrast, the use of a water-insoluble quaternary polymer in the present invention provides the coating with water resistance while also serving to hold the ink once it has been absorbed into the cross-linked network.

In the inventive materials, a multifunctional cross-linking agent is used to crosslink the gelatin binder with the water-insoluble quaternary cationic polymer and to form an IPN structure. The crosslinking and IPN formation give inventive ink jet receptive coatings water resistance and the property of good wet adhesion to the substrate, to which they are applied to, and which is important property for achieving a waterfast media. The crosslinking agent should have multifunctional groups that produce an adequate degree of cross-linking (cross-linking density) for ink jet recording applications. Multifunctional cross-linking agents having at least three functional groups are preferred.

The multifunctional cross-linking agents are preferably selected from a group consisting of multifunctional cross-linkable polymers, aziridine, cymel, multifunctional epoxy molecules and resins, gelatin hardeners, and the like.

Cross-linking agents that strongly react with polymers at room temperature (about 23–°25° C.) or at slightly higher temperatures during mixing, normally give short pot life, such that coating processes therewith are difficult to control. Also, due to the interaction of the functional groups in the polymer with such crosslinking agents during mixing, the wet adhesion of the final coatings to the substrates is generally not very good.

In arriving at the instant invention, the inventors hereof discovered that the use of multifunctional cross-linking agents that are reactive at relatively high temperatures of over about 100–° C. result in a superior cross-linked product for ink jet recording applications. Preferred high temperature multifunctional cross-linking agents having at least three functional groups are molecules with multi-epoxy functional groups, gelatin hardeners, cymel and other melamine resins. In this regard, this cross-linking system gives coating compositions that offer good pot life, enable a workable coating process, and result in dried ink jet receptive layers that possess good wet adhesion to the substrates.

In the inventive water-insoluble ink receptive materials, the content of multifunctional cross-linking agent in the dried coating is from about 0.05% to about 10%, dependent on specific crosslinker and coating system. Preferably, the content of multifunctional cross-linking agent in the dried coating is from about 0.1% to about 5%.

An ink receptive coating of the invention may also contain from about 0.5 to 30%, by weight (based on the total weight of solids in the coating), of pigment particles to obtain either glossy media that does not possess tacky problems or a matted media. However, from about 15–25%, by weight (based on the total weight of solids in the coating) of inorganic pigment is thought preferable for preparing matted media while from about 0.5 to 1% by weight (based on the total weight of solids in the coating) of organic pigment is preferred in order to produce glossy media having no tacky problems associated therewith. Pigments that may be used in preparing the inventive media are selected from both organic and inorganic pigments. Inorganic pigments such as silica has an average agglomerate size of 1–10 micron, with preferable organic pigments including poly- (methyl methacrylate) (PMMA) beads and fluorinated polymer beads of from about 1 to 10 microns in diameter.

In a preferred embodiment of the instant invention, an ink receptive coating is prepared and coated onto a base substrate to form an ink jet recording medium. Suitable base substrates include thermoplastic polymers such as polyesters, poly(sulfones), poly(vinyl chloride), poly(vinyl acetate), polycarbonates, poly(methyl methacrylate), cellulose esters, poly(ethylene) coated paper, clay coated paper, polyester white film and others. A poly(ethylene) terephthalate film is a particularly preferred base substrate.

Coating can be conducted by any suitable means including roller coating, extrusion coating, wire-bar coating, dip-coating, rod coating, doctor coating, or gravure coating. Such techniques are well known in the art.

In order to illustrate more fully the various embodiments of the present invention, the following non-limiting examples are provided.

EXAMPLE 1

| | |
|---|---|
| Gelatin[1] | 8.0 part |
| Syntran HX31–65 | 12.0 part |
| Heloxy Modifier 48[2] | 1.2 part |
| Water | 78.8 part |

[1]Kind & Knox Gelatin, Type 7838
[2]Epoxy group-containing cross-linking agent (Shell Chemical)

This coating formulation is prepared by dissolving gelatin in water of about 60–70° C., and adding the Syntran HX31-65 and Heloxy Modifier 48 to the gelatin-water solution. The formulation is coated onto DuPont 7 Mil 534 white film with a Meyer rod and dried in a 150° C. oven for 3 min.

EXAMPLE 2

| | |
|---|---|
| Gelatin | 11.4 part |
| Syntran HX31–65 | 11.4 part |
| CR-5L[1] | 1.1 part |
| Water | 76.1 |

[1]Multifunctional aliphatic epoxide (Esprit Chemical Company)

This coating formulation is prepared by dissolving gelatin in water of about 60–70° C., and adding the Syntran HX31-65 and CR-5L to the gelatin-water solution. The formulation is coated onto DuPont 7 Mil 534 white film with a Meyer rod and dried in a 150° C. oven for 3 min.

EXAMPLE 3

| | |
|---|---|
| Gelatin | 11.0 part |
| Syntran HX31–65 | 13.0 part |
| Heloxy Modifier 48 | 0.2 part |
| Water | 75.8 part |

This coating formulation is prepared by dissolving gelatin in water of about 60–70° C., and adding the Syntran HX31-65 and Hyloxy Modifier 48 to the gelatin-water solution. The formulation is coated onto DuPont 7 Mil 534 white film with a Meyer rod and dried in a 150° C. oven for 3 min.

EXAMPLE 4

| | |
|---|---|
| Gelatin | 12.32 part |
| Syntran HX31–65 | 15.06 part |
| Cymel 325[1] | 0.09 part |
| Water | 72.06 part |

[1]Melamin resin (Cytec Industries)

This coating formulation is prepared by dissolving gelatin in water of about 60–70° C., and adding the Syntran HX31-65 and Cymel 325 to the gelatin-water solution. The formulation is coated onto DuPont 7 Mil 534 white film with a Meyer rod and dried in a 150° C. oven for 3 min.

EXAMPLE 5

| | |
|---|---|
| Gelatin | 9.3 part |
| Syntran HX31–65 | 11.3 part |
| Heloxy Modifier 48 | 0.4 part |
| FK-310[1] | 3.6 part |
| Water | 75.4 part |

[1]Precipitated silica (Degussa Corp.)

This coating formulation is prepared by dissolving gelatin in water of about 60–70° C., and adding the Syntran HX31-65, Hyloxy Modifier 48, and a 15% by weight pigment (FK-310) stock solution to the gelatin-water solution. The formulation is coated onto DuPont 7 Mil 534 white film with a Meyer rod and dried in a 150° C. oven for 3 min.

EXAMPLE 6

| | |
|---|---|
| Gelatin | 11.0 part |
| Syntran HX31–65 | 13.0 part |
| OB1207E[1] | 0.24 part |
| Water | 75.8 part |

[1]Gelatin hardener from H. W. Sands Corporation

This coating formulation is prepared by dissolving gelatin in water of about 60–70° C., and adding the Syntran HX31-65, and OB1207E to the gelatin-water solution. The formulation is coated onto DuPont 7 Mil 534 white film with a Meyer rod and dried in a 150° C. oven for 3 min.

COMPARATIVE EXAMPLE 1

| | |
|---|---|
| Gelatin | 11.0 part |
| Syntran HX31–65 | 13.0 part |
| Water | 76.0 part |

This coating formulation is prepared by dissolving gelatin in water of about 60–70° C., and adding the Syntran HX31-65 to the gelatin-water solution. The formulation is coated onto DuPont 7 Mil 534 white film with a Meyer rod and dried in a 150° C. oven for 3 min.

COMPARATIVE EXAMPLE 2

| | |
|---|---|
| Gelatin | 11.0 part |
| Heloxy Modifier 48 | 0.2 part |
| Water | 88.8 part |

This coating formulation is prepared by dissolving gelatin in water of about 60–70° C., and adding Hyloxy Modifier 48 to the gelatin-water solution. The formulation is coated onto DuPont 7 Mil 534 white film with a Meyer rod and dried in a 150° C. oven for 3 min.

COMPARATIVE EXAMPLE 3

| | |
|---|---|
| Gelatin | 11.0 part |
| Cymel 325 | 0.05 part |
| Water | 88.9 part |

This coating formulation is prepared by dissolving gelatin in water of about 60–70° C., and adding Cymel 325 to the gelatin-water solution. The formulation is coated onto DuPont 7 Mil 534 white film with a Meyer rod and dried in a 150° C. oven for 3 min.

COMPARATIVE EXAMPLE 4

| | |
|---|---|
| Gelatin | 11.0 part |
| Hyloxy Modifier 48 | 0.2 part |
| Gafquat 755 | 22.8 part |
| Water | 66.1 part |

This coating formulation is prepared by dissolving gelatin in water of about 60–70° C., and adding Gafquat 755 and Hyloxy Modifier 48 to the gelatin-water solution. The formulation is coated onto DuPont 7 Mil 534 white film with a Meyer rod and dried in a 150° C. oven for 3 min.

COMPARATIVE EXAMPLE 5

| | |
|---|---|
| Gelatin | 11.0 part |
| Hyloxy Modifier 48 | 0.15 part |
| Celquat H100 | 29.4 part |
| Water | 59.4 part |

This coating formulation is prepared by dissolving 11.0 part of gelatin in water of about 60–70° C., and adding 29.4 part of 2% Celquat H100 and 0.15 part of Hyloxy Modifier 48 to the gelatin-water solution. The formulation is coated onto DuPont 7 Mil 534 white film with a Meyer rod and dried in 150° C. oven for 3 min.

The inventive ink-receptive coatings comprising a crosslinked product of the gelatin and the water-insoluble quaternary cationic polymer have good water resistance and dye-fixing capability. Wet adhesion of all examples of the present invention is good to many substrates including, but not limited to, polyethylene coated paper (such as Schoeller paper), clay coated paper, and clear and white polyester film (such as ICI aqueous pretreated clear and white polyester film). The cured coatings can sustain over 200 rub with water while still maintain good image quality. The prepared ink receptive coatings of this invention with the exception of Example 5 were generally also very glossy. The printed image remained intact after immersion in water for several weeks. The image can also survive smearing in water.

Coatings without either crosslinker (Comparative Example 1) or quaternary polymers (Comparative Examples 2 & 3), and coatings comprising crosslinked gelatin and water-soluble quaternary polymer (Comparative Examples 4 & 5) have less water resistance and dye-fixing capability. As mentioned previously, the water resistance and dye-fixing capability of the invented ink-receptive coating is contributed to by both the crosslinked network and the hydrophobicity of the water-insoluble quaternary polymer. Lack of either contribution can significantly reduce the water resistance and the dye-fixing capability of the coating. For example, in the prepared media of Comparative Example 1, the coating came off the substrate when rubbed or smeared, even though the dyes were fixed in the coating. Likewise, with the prepared media of Comparative Examples 2–5, better coating adhesion and wet strength was obtained, but most of the images applied thereto were washed off when contacted with water as shown in Tables II(a) and II(b).

TABLE II(a)

% Color Lost of Prepared Media*

| | Composite Black | Red | Green | Yellow | Blue | Magenta | Cyan |
|---|---|---|---|---|---|---|---|
| Example 1 | −18.0 | −4.0 | −22.7 | −11.4 | −11.4 | −12.2 | −67.4 |
| Example 2 | −33.3 | −9.1 | −48.1 | −15.9 | −32.0 | 5.6 | −74.5 |
| Example 3 | −23.5 | −15.3 | −23.6 | −21.7 | −24.3 | −16.7 | −57.4 |
| Example 6 | −20.6 | −8.0 | −22.0 | −2.3 | −27.5 | −9.5 | −44.3 |
| Comparative Example 1 | −14.0 | −4.1 | −26.1 | −8.9 | −27.5 | −1.3 | −67.8 |
| Comparative Example 2 | 32.4 | 35.1 | 11.9 | 82.7 | 24.9 | 21.2 | −14.6 |
| Comparative Example 3 | 48.2 | 24.8 | 17.2 | 81.1 | 28.1 | 4.0 | −7.4 |
| Comparative Example 4 | 42.5 | 12.1 | 9.3 | 81.5 | 11.0 | 14.5 | −17.6 |
| Comparative Example 5 | 45.3 | 36.4 | 28.9 | 86.8 | −33.3 | 31.9 | 0 |

*Imaged medium (HP87OCxi ink jet printer) is placed in water for 24 hr.

TABLE II(b)

% Color Lost of Prepared Media*

| | Composite Black | Red | Green | Yellow | Blue | Magenta | Cyan |
|---|---|---|---|---|---|---|---|
| Example 1 | −0.5 | −19.9 | −10.1 | −4.5 | −12.4 | −12.7 | −7.2 |
| Example 2 | −6.4 | −34.4 | −17.5 | −15.0 | −26.4 | −34.1 | −4.4 |
| Example 3 | −5.4 | −27.7 | −21.2 | 2.7 | −31.2 | −16.9 | −30.0 |
| Example 6 | −1.7 | −34.4 | −29.1 | 2.7 | −36.8 | −16.5 | −30.0 |
| Comparative Example 1 | −1.3 | −31.0 | −20.7 | 6.8 | −35.1 | −25.7 | −25.3 |
| Comparative Example 2 | 41.3 | −2.3 | −35.4 | 21.1 | −29.9 | 3.4 | −49.3 |
| Comparative Example 3 | 53.4 | 3.5 | −43.1 | 46.8 | −31.8 | 11.7 | −43.5 |
| Comparative Example 4 | 26.0 | −10.8 | −26.5 | 18.3 | −27.3 | −13.7 | |
| Comparative Example 5 | 46.8 | −7.6 | −36.6 | 39.7 | −31.9 | 0.8 | −41.4 |

*Image medium (Canon 4300 ink jet printer) is placed in water for 24 hr.

With regard to the results provided in Tables II(a) and II(b), the following is particularly noted. All the formulation were coated onto DuPont 7 Mil 534 white film with a #40 Meyer rod and dried in a 150° C. oven for 3 min. The films were then printed on Canon 4300 and HP 870Cxi. The printed samples were immersed in water for 24 hours at ambient temperature (about 22° C.). Optical density of the printed image before and after immersion was measured with a Macbeth Transmission densitometer RD-933. The "% color lost" values reported in the above tables is defined as a percentage (%) obtained by the formula:

$$[(ODo-OD)/ODo]\cdot(100),$$

where ODo is the optical density of the original image and OD is the optical density after immersion in water for 24 hours. The negative results are due to the spreading of ink dots and indicate no color lost.

As can be seen in Tables II(a) and Table II(b), all of the examples of the present invention exhibited excellent dye fixing property than all the comparative examples. On HP 870Cxi prints (Table II(a)), the invented waterfast media has no color lost on almost all dyes while the Comparative Examples 2–5 lost up to 80% color except cyan. The Comparative Example 1 shown no color lost but it has bad wet adhesion to the substrate. When touch and smeared in water, the coating was stick and came off the substrate. On Canon 4300 prints (Table II(b)), the inventive waterfast media also has no color lost while substantial color lost, especially yellow and black color was observed on all most all the comparative examples.

Accordingly, the test results reported in Tables II(a) and II(b) hereof demonstrate the significant advantage of the water-insoluble quaternary cationic polymer in dye-fixing compared to the water soluble cationic polymers. It also demonstrates the importance of the crosslinked IPN structure in dye-fixing.

TABLE III(a)

Light Fade (Delta E) of the Printed Images

Example 5 (40 Hr Exposure)

| | Canon 4300 | Epson 800 | HP870Cxi | HP550C | Lexmark 7200 |
|---|---|---|---|---|---|
| White | 1.42 | 1.58 | 2.16 | 1.34 | 1.61 |
| Black | 2.15 | 2.39 | 18.34 | 3.21 | 24.59 |
| Red | 14.39 | 4.79 | 17.31 | 33.82 | 17.79 |
| Green | 7.85 | 8.04 | 27.6 | 51.5 | 33.34 |
| Yellow | 1.44 | 1.17 | 7.8 | 19.99 | 32.99 |
| Blue | 17.17 | 19.04 | 11.76 | 59.29 | 10.85 |
| Magenta | 14.54 | 4.23 | 5.31 | 48.37 | 6.02 |
| Cyan | 2.34 | 4.53 | 8.37 | 45.19 | 1.95 |

TABLE III(b)

Light Fade (Delta E) of the Printed Images

| | Canon 4300 | Epson 800 | HP870Cxi |
|---|---|---|---|
| Example 3 (48 Hr Exposure) | | | |
| White | 0.78 | 0.78 | 0.72 |
| Black | 6.75 | 10.89 | 19.69 |
| Red | 19.6 | 31.08 | 18.76 |
| Green | 9.57 | 26.42 | 25.55 |
| Yellow | 1.20 | 24.01 | 3.62 |
| Blue | 17.77 | 46.46 | 13.08 |
| Magenta | 24.03 | 31.36 | 4.64 |
| Cyan | 3.41 | 31.54 | 8.16 |

TABLE IV

Color Gamut of the Printed Images

| | Canon 4300 | Epson 800 | HP870Cxi | HP550C | Lexmark 7200 |
|---|---|---|---|---|---|
| Example 1 | 1786 | | 2095 | | |
| Example 2 | 1582 | | 2054 | | |
| Example 3 | 1441 | 2414 | 2569 | | 1791 |
| Example 5 | 1155 | 1502 | 1721 | 1656 | 971 |
| Example 6 | 1779 | | 1966 | | |

With regard to the comparative test results reported in provided in Tables III(a), III(b), and IV, the following is noted.

All the formulation were coated onto DuPont 7 Mil 534 white film with a #40 Meyer rod and dried in a 150° C. oven for 3 min., printed from different printers, and exposed to a UV beam for certain time in an ATLAS SunChex UV chamber. Example 3 was also coated on DuPont 4 Mil 534 film. CIELAB L*, a*, b* numbers before and after exposure to UV light were measured and Delta E, which quantifies the light fade, was calculated according to the following formula:

$$\text{Delta } E=[(\Delta L^*)^2+(\Delta a^*)^2+(\Delta b^*)^2]^{1/2}$$

The light fade property of the printed image on the medium of the present invention is good compared to most product in the market.

Color gamut is used to define the color density or richness. It is calculated from the following formula:

$$\text{Gamut}=(4/3)\pi(L^*_{white}-L^*_{black})(a^*_{max}-a^*_{min})(b^*_{max}-b^*_{min}))/10^3$$

From the results shown in Tables III(a), III(b) and Table IV, one can see that the instant inventive waterfast media print well on most of the printers in the market with good printing quality and UV light resistance. There were no significant difference of light fade and color gamut between the inventive media and the controls.

The present invention is not to be construed as being limited to the particular exemplary embodiments set forth above. This is because, those skilled in the art will realize that various possible modifications and changes can be made to the inventive embodiments herein disclosed, without departing from the scope or scope of the present inventive discovery. Accordingly, the present invention is not to be unduly limited to the illustrative embodiments set forth herein, but is instead only to be limited by the scope of the claims appended hereto and the equivalents thereof.

What is claimed is:

1. An ink receptive material comprising a substrate coated on at least one surface with a water-insoluble ink receptive coating, said coating comprising a gelatin, a water-insoluble quaternary cationic polymer that is a copolymer derived from at least one water-insoluble monomer and at least one water-soluble monomer, and a multifunctional cross-linking agent.

2. An ink receptive material according to claim 1, wherein said water-insoluble ink receptive coating further contains 0.5–1% by weight of pigment, based on the total weight of solids in the coating.

3. An ink receptive material according to claim 1, wherein said gelatin is a gelatin having a Bloom number from about 100 to about 300, and viscosity from 3 to 55 m Pa.s.

4. An ink receptive material according to claim 1, wherein said gelatin is a gelatin derived from an acid treated precursor.

5. An ink receptive material according to claim 1, wherein said gelatin is a gelatin derived from an alkali treated precursor.

6. An ink receptive material according to claim 1, wherein said water-insoluble quaternary polymer has an average molecular weight of 1,000 to 10,000 g/mole.

7. The ink-receptive material according to claim 1, wherein said water-soluble monomer has at least one reactive functional substituent group.

8. The ink-receptive material according to claim 1, wherein said water-soluble monomer has at least one reactive functional substituent group, which is selected from the group consisting of a hydroxyl-, a carboxylic-, and an amine- containing functional substituent group.

9. The ink-receptive material according to claim 1, wherein said water-soluble monomer is selected from the group consisting of quaternized dialkylaminoalkyl methacrylate and methyl quaternized dialkylaminoalkyl acrylate.

10. An ink receptive material according to claim 1, wherein said water-insoluble quaternary polymer has at least one hydrophobic molecular component.

11. The ink-receptive material according to claim 1, wherein said water-insoluble monomer is selected from the group consisting of alkyl methacrylate and alkyl acrylate.

12. An ink receptive material according to claim 1, wherein said multifunctional cross-linking agent is selected from the group consisting of epoxies, aziridines, cymel and melamine resins, gelatin hardeners, and multifunctional cross-linker polymers.

13. An ink receptive material according to claim 1, wherein the content of said multifunctional cross-linking agent in the dried coating is about 0.05% to about 10% by weight, based on the total weight of solids in said coating.

14. An ink receptive material according to claim 1, wherein the content of said gelatin in the dried coating is about 30% to 90% by weight, based on the total weight of solids in said coating.

15. An ink receptive material according to claim 1, wherein the content of said water-insoluble quaternary polymer in the dried coating is about 0% to about 40% by weight, based on the total weight of solids in said coating.

16. A process for preparing the water-insoluble ink receptive coating of the ink receptive material recited in claim 1, comprising cross-linking the gelatin and the water-insoluble quaternary cationic polymer together with the multifunctional cross-linking agent, and optionally a pigment, to form the water-insoluble ink receptive coating.

17. The process according to claim 16, wherein said gelatin, said water-insoluble cationic quaternary polymer, and optionally said pigment, are cross-linked at a temperature greater than or equal to 100° C. by said multifunctional cross-linking agent.

18. A matted ink receptive material comprising a substrate coated on at least one surface with a water-insoluble ink receptive coating, said coating comprising a gelatin; a water insoluble quaternary polymer that is a copolymer derived from at least one water-insoluble monomer and at least one water-soluble monomer, and a multifunctional cross-linking agent.

19. A matted ink receptive material according to claim 18, where said water-insoluble ink receptive coating further comprises from about 0.5 to 25% by weight of pigment, based on the total weight of solids in the coating.

* * * * *